US006659226B2

(12) United States Patent
Sarrazy

(10) Patent No.: US 6,659,226 B2
(45) Date of Patent: Dec. 9, 2003

(54) SCAFFOLDING SYSTEM FOR VOLUMES OF VARIOUS SHAPES

(75) Inventor: Jean-Pierre Sarrazy, Andresy (FR)

(73) Assignee: Entrepose Echafaudages, La Courneuve (FR)

( * ) Notice: Subject to any disclaimer, the term of this patent is extended or adjusted under 35 U.S.C. 154(b) by 0 days.

(21) Appl. No.: 09/922,761

(22) Filed: Aug. 6, 2001

(65) Prior Publication Data

US 2002/0040829 A1 Apr. 11, 2002

(51) Int. Cl.[7] ..... E04G 1/36

(52) U.S. Cl. ..... 182/128; 182/131; 182/141; 182/146

(58) Field of Search ..... 182/62.5, 146, 182/178.1, 179.1, 131, 128, 228, 141; 52/126, 645

(56) References Cited

U.S. PATENT DOCUMENTS

| | | | | | |
|---|---|---|---|---|---|
| 3,822,000 | A | * | 7/1974 | Maeda | 182/82 |
| 4,057,943 | A | | 11/1977 | Lienhard | |
| 5,613,573 | A | | 3/1997 | L'Hermine | |
| 5,685,392 | A | * | 11/1997 | Phillips et al. | 182/131 |
| 5,701,704 | A | * | 12/1997 | Landes | 52/64 |
| 5,746,290 | A | * | 5/1998 | St-Germain et al. | 182/146 |
| 6,095,285 | A | * | 8/2000 | St-Germain | 182/146 |
| 6,102,157 | A | * | 8/2000 | Goldbach et al. | 182/128 |

FOREIGN PATENT DOCUMENTS

| | | |
|---|---|---|
| EP | 0 968 914 A1 | 5/2000 |
| GB | 1 375 051 | 11/1974 |
| GB | 1 382 112 | 1/1975 |
| WO | WO 93/20307 | 10/1993 |

* cited by examiner

*Primary Examiner*—Bruce A. Lev
(74) *Attorney, Agent, or Firm*—Merchant & Gould, P.C.

(57) ABSTRACT

A scaffolding system for volumes of various shapes that present a bottom and end walls. The system includes at least a first scaffolding structure having a gantry with at least two interconnected vertical poles; guides secured to the bottom of the volume to guide the poles in rectilinear displacement in a longitudinal direction; a horizontal main platform defining at least a working floor, and guides for guiding the main platform in vertical translation along the poles; at least two horizontal auxiliary platforms each defining a working floor mounted to move in horizontal translation relative to the main platform; and structure for displacing each auxiliary platform separately relative to the main platform between a retracted position and an extended position in which the outer edge of the auxiliary platform is substantially in register with the outer edge of the main platform.

17 Claims, 6 Drawing Sheets

SCAFFOLDING SYSTEM FOR VOLUMES OF VARIOUS SHAPES

The present invention relates to a scaffolding system for volumes of various shapes, and particularly but not exclusively for use in lagging the tanks of liquefied gas tanker ships.

BACKGROUND OF THE INVENTION

More generally, the invention relates to scaffolding systems that can be put in place inside enclosures whose walls can present a wide variety of shapes, and in particular can be spherical, cylindrical, of polygonal vertical section, or indeed a combination of such shapes.

This problem is to be found in particular when applying the thermal insulation or "lagging" to tanks in ships used for transporting liquefied gas.

Accompanying FIGS. 1A and 1B are a longitudinal section and a cross-section through a ship for transporting liquefied gas. The ship 10 has a plurality of tanks 12, 14, 16, and 18 disposed along the length of its hull. When the ship is being built and after the tanks have been made, at least once the main walls 20 thereof have been made, it is necessary to lag these walls 20 with an insulating structure, possibly constituted by a plurality of layers of material. FIG. 1B is a cross-section through a typical shape for such a tank 14. It comprises a floor or bottom 20, a ceiling 26 having an access opening 30, and vertical side walls 22 and 24. The floor 20 is connected to the side walls via bottom sloping walls 32 and 34, while the ceiling 26 is connected to the side walls via top sloping walls 36 and 38. The tank also has a vertical front wall 35 and a vertical rear wall 37.

It will be understood that with such tanks, or more generally with similar enclosures, the problem when making scaffolding consists firstly in the difficulty of gaining access to the enclosure and secondly in the unusual and irregular shape of the walls which the scaffolding is to face once it has been erected.

It will also be understood that when building a ship for transporting liquefied gas, the time required for building is a parameter that is economically decisive. It is therefore very desirable for shipyards to have scaffolding systems for putting into place, in particular inside tanks, which systems should be suitable for being put into place and then dismantled relatively quickly and should be suitable for use with the particular shape of the walls to which the scaffolding system is intended to give access.

Furthermore, in order to obtain a better understanding of the problem posed, it needs to be recalled that the width of the tank can be about 30 meters (m), that the length of the tank can be about 40 m and that the height of the tank is likewise about 30 m. It can thus be seen that the area of the walls to which the scaffolding system is to give access is very large.

Accompanying FIG. 1C is a cross-section through another volume shape which also requires scaffolding to be put into place for lagging its walls. This tank comprises a wall 11 and a coffer 13. In right section, the wall comprises a bottom 21, side walls 23 and 25, and a ceiling 27 pierced by an access opening 28. Top sloping walls 29 and 31 and bottom sloping walls 33 and 39 interconnect the side walls with the ceiling and the bottom.

It will be understood that installing scaffolding inside such a tank raises special problems.

In patent application WO 93/20307, scaffolding is described for working inside the tank of a methane tanker, which scaffolding comprises a carrier structure made up of two legs interconnected by cross-members forming a gantry, and by a large number of modular platforms mounted at various heights and cantilevered out from the outside face of said legs.

Such a structure requires erection time that is lengthy insofar as it must be made along the entire length of the tank and insofar as it requires a very large amount of scaffolding material, in particular for making the modular platforms.

Document U.S. Pat. No. 4,057,943 also describes a scaffolding structure, in particular for the tanks of a methane tanker, in which a carrier structure is assembled inside the tank, the structure standing on the bottom of the tank and carrying a set of platforms including adjustable ends for giving access to the different portions of the inside wall of the tank.

SUMMARY OF THE INVENTION

An object of the present invention is to form a scaffolding system for volumes of various shapes and in particular for tanks for storing or transporting liquefied gas, enabling the scaffolding to be put into place quickly inside the volume and making the scaffolding easy to use without requiring a large quantity of scaffolding elements to be involved.

The invention achieves this object by means of a scaffolding system for volumes of various shapes presenting a bottom and end walls, the system being characterized in that it comprises at least a first scaffolding structure comprising:

- a gantry-forming structure comprising at least two vertical poles interconnected to form a gantry, each of said poles having a bottom end;
- means secured to said bottom of the volume to guide said bottom ends of the poles in rectilinear displacement in a longitudinal direction on said bottom;
- means forming a horizontal main platform and means for guiding said main platform-forming means in vertical translation along said poles, said platform-forming means having two end edges in a direction orthogonal to the displacement direction of said gantry;
- at least two horizontal auxiliary platforms mounted to move in horizontal translation relative to said main platform, each platform having an outer edge; and
- means for displacing each auxiliary platform separately relative to the main platform between a retracted position in which the outer edge of the auxiliary platform is retracted relative to the outer edge of the main platform, and an extended position in which the outer edge of the auxiliary platform is substantially vertically in register with the outer edge of the main platform.

It will be understood that this scaffolding system has three degrees of freedom to give access to all of the portions of the wall of the volume in which the scaffolding is erected. Longitudinal displacement of the gantry-forming structure constitutes one degree of freedom in the length direction of the volume, vertical displacement of the main platform relative to the gantry constitutes a second degree of freedom in the height direction of the volume, and the ability of the two auxiliary platforms to be displaced relative to the main platform enable the outline of the scaffolding to be matched to the different portions of the wall of the volume at different levels.

In a preferred embodiment, the scaffolding system further comprises at least second and third scaffolding structures very similar to said first scaffolding structure. These two scaffolding structures make it possible to work on the extreme front and rear walls of the tank, the moving first scaffolding structure making it possible to work on the side walls between the two end structures.

Preferably, the edges of the end scaffolding structures facing the end wall have respective telescopic extensions.

BRIEF DESCRIPTION OF THE DRAWINGS

Other characteristics and advantages of the invention will appear better on reading the following description of a preferred embodiment of the invention given by way of non-limiting example. The description refers to the accompanying figures, in which.

DETAILED DESCRIPTION OF THE PREFERRED EMBODIMENTS

Figure 5:
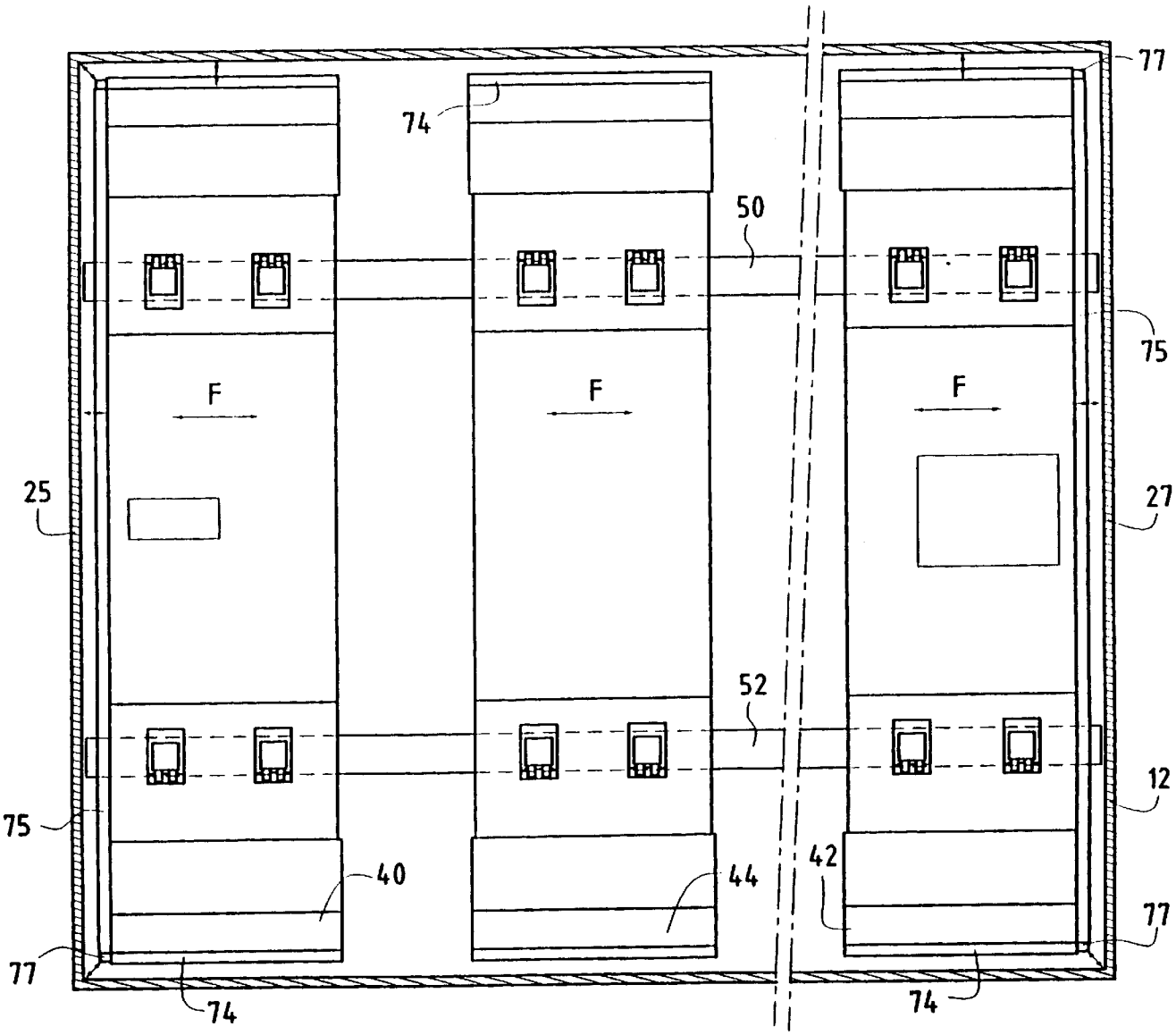
FIG. 5 is a plan view showing the entire scaffolding system made up of three scaffolding structures.

With reference initially to FIG. 5, it can be seen that in a preferred embodiment, the scaffolding system for use inside the tank 12 is constituted by three scaffolding structures There are two end structures having respective references 40 and 42 disposed respectively in the vicinity of the front wall 25 and of the rear wall 27 of the tank 12. The scaffolding system has a third scaffolding structure 44 disposed between the structures 40 and 42, and it could optionally have a plurality of intermediate structures. These structures 40, 42, and 44 are displaceable in the direction of arrow F, i.e. in the long direction of the tank 12, between the front and rear walls 25 and 27 thereof. For this purpose, longitudinal rails or running elements 50 and 52 are placed on the bottom 20 of the tank. These rails can be lifted to enable the bottom of the tank to be lagged.

Since the scaffolding structures 40, 42, and 44 are substantially identical, the description below goes into greater detail for the intermediate structure 44.

In shorter tanks, the scaffolding system could comprise a single scaffolding structure 44 on its own. The rails 50 and 52 must allow the gantry of said structure to be displaced along the entire length of the tank.

In contrast, in longer tanks, or more generally in longer volumes, a plurality of intermediate scaffolding structures identical to the structure 44 can be provided so as to reduce the total time required to take action inside the volume.

Figure 1A:
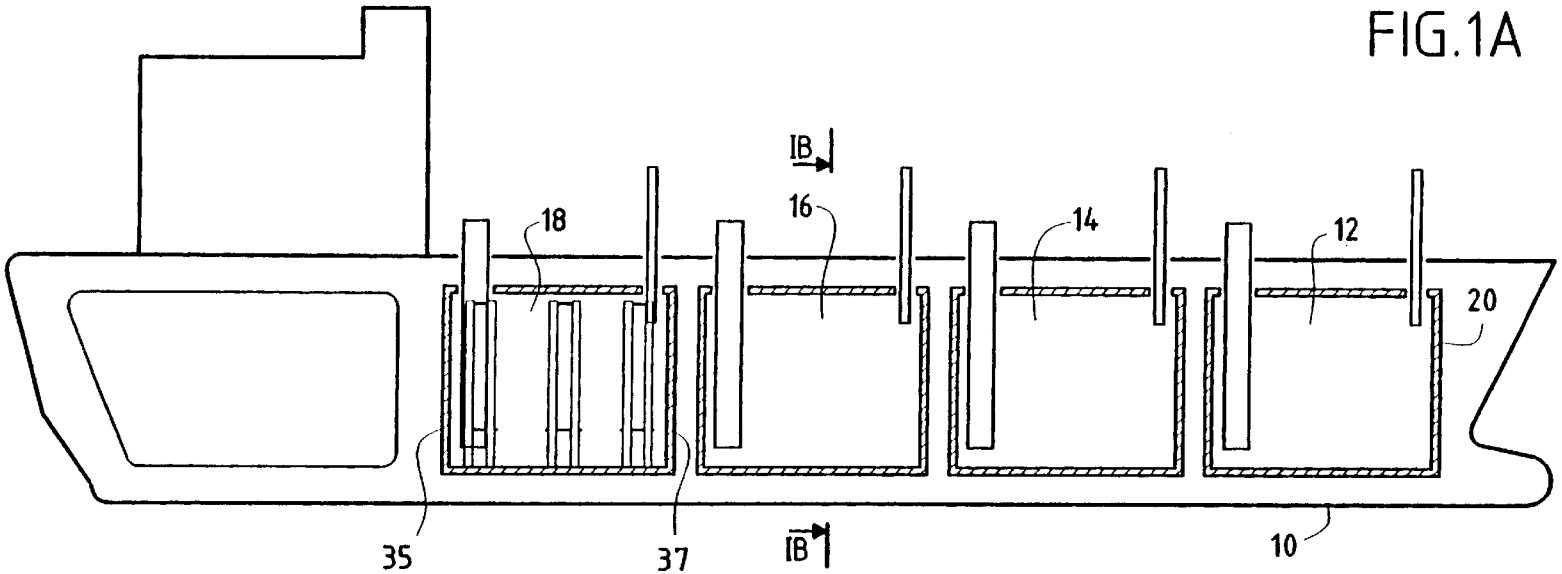
FIG. 1A, described above, is a longitudinal section through a ship for transporting liquefied gas.
Figure 1B:
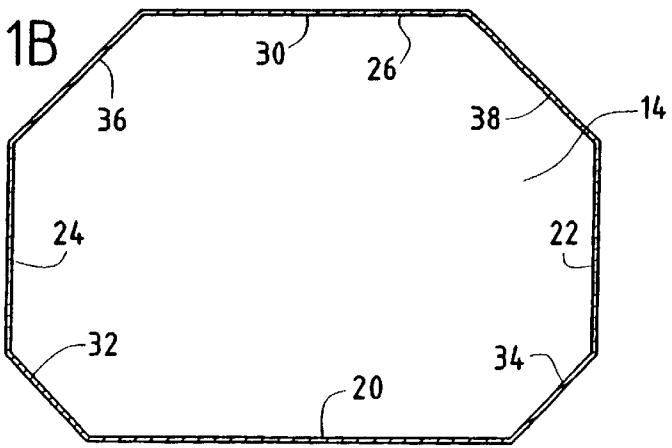
FIG. 1B, described above, is a section on line B—B of FIG. 1A.
Figure 1C:
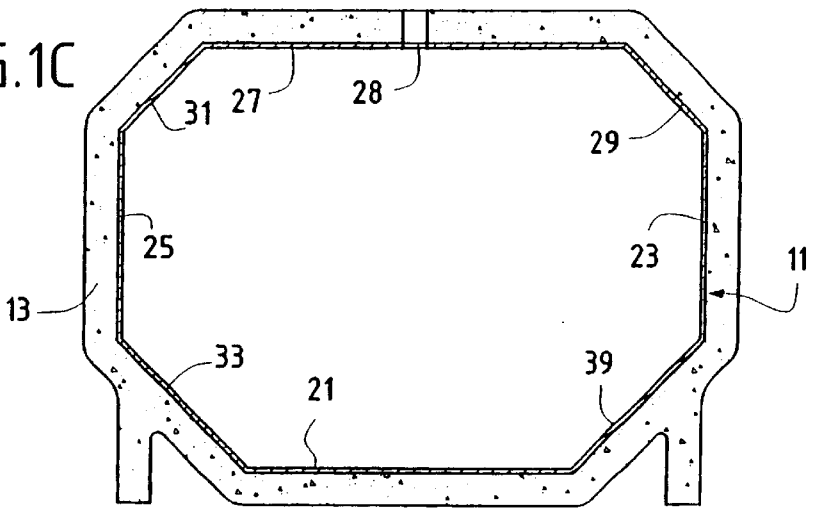
FIG. 1C is a cross-section through another kind of volume.
Figure 2:
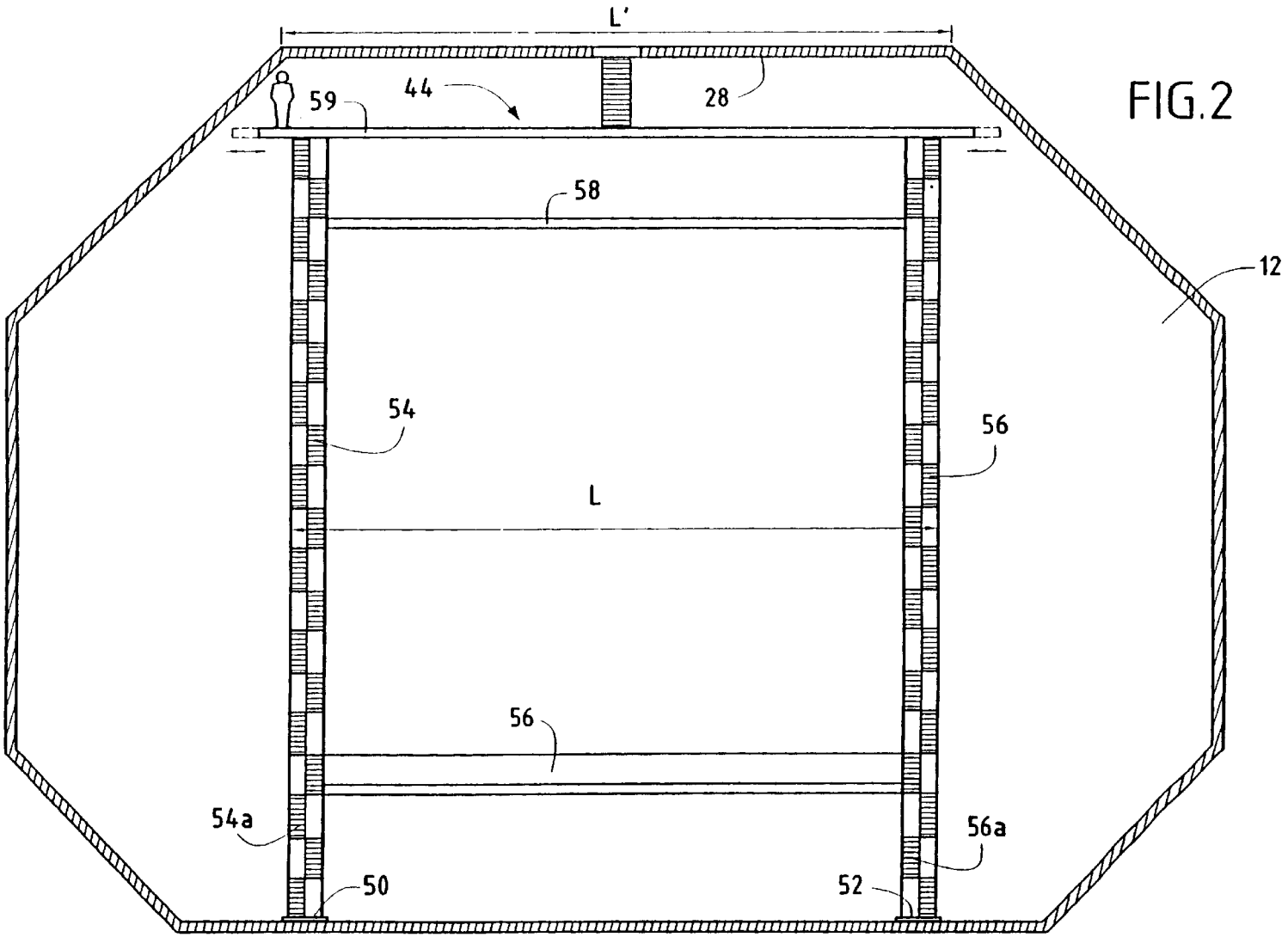
FIG. 2 is a cross-section view showing the carrier structure of the scaffolding system.

FIG. 2 shows the carrier portion of the scaffolding structure 44. This is in the form of a gantry that is preferably constituted by four vertical poles, with only the poles 54 and 56 being visible. The vertical poles are interconnected close to their bottom portions by a set of horizontal beams 56, and close to their top portions by a set of horizontal beams 58, the assembly thus constituting a rigid gantry. The top end of the gantry is preferably fitted with a working floor 59 giving access to the ceiling 28 of the tank.

The width L of the gantry is slightly less than the smallest width L' of the tank wall. In the particular case shown in FIG. 2, this smallest width L' of the tank corresponds to the ceiling thereof.

As already mentioned, the bottom ends 54*a*, 56*a* of the poles are fitted with running elements for cooperating with the rails 50 and 52 and to allow the gantry to be displaced in the long direction of the tank.

The scaffolding structure has a main horizontal platform 60 which can be displaced vertically while being guided by the vertical poles of the gantry. The central portion of the platform 60 is constituted by a lattice structure 62 having guide elements such as 64 fixed thereto for guiding the main platform 60 in translation up and down the poles 54, 56. Motor means (not shown) serve to control displacement of the main platform 60 up and down the poles 54, 56. Each guide element 64 is preferably fitted with its own motor means, with all four motor means naturally being mutually synchronized so as to ensure that the main platform is displaced perfectly horizontally. It would not go beyond the ambit of the invention if only some of the guide elements 64 were to be fitted with motor means, while the other guide elements merely act as guides only.

Working floors are fixed to the central structure 62 of the main platform 60 and outside the zone defined by the four poles 54. Two working floors 66 and 68 are preferably provided defining two vertically separated working levels. Top and bottom auxiliary platforms 70 and 72 are mounted on each of the working floors 66 and 68 of the main platform 60. These auxiliary platforms can be moved horizontally relative to the working floors 66 and 68 between a retracted position in which the platforms are adjacent to the vertical poles, and an extended position in which the platforms can be as far out as the edges 66*a* and 68*a* of the working floors 66 and 68. It will be understood that at each end of the main platform, there are two working levels 66 and 68 that are stationary and two working levels that are movable in a horizontal direction and constituted by the top and bottom platforms 70 and 72, each of which has its own working floor.

Each working floor 66, 68, 70, and 72 is preferably fitted with a telescopic extension 74 that can be moved in a horizontal direction and that is suitable for projecting beyond the outer edges of the working floors. These extensions 74 give access to the vertical walls and to the top and bottom sloping walls and they enable the positions of the working zones to be matched to the shape of the walls of the volume and to installing successive different layers of coating that are to be put into place on the walls.

The vertical poles 54 and 56 can be fitted with service ladders or stairways 80 and a lift or elevator 82 is provided between the top platform 60, 69 of the gantry and the bottom 20 of the tank.

Figure 4:
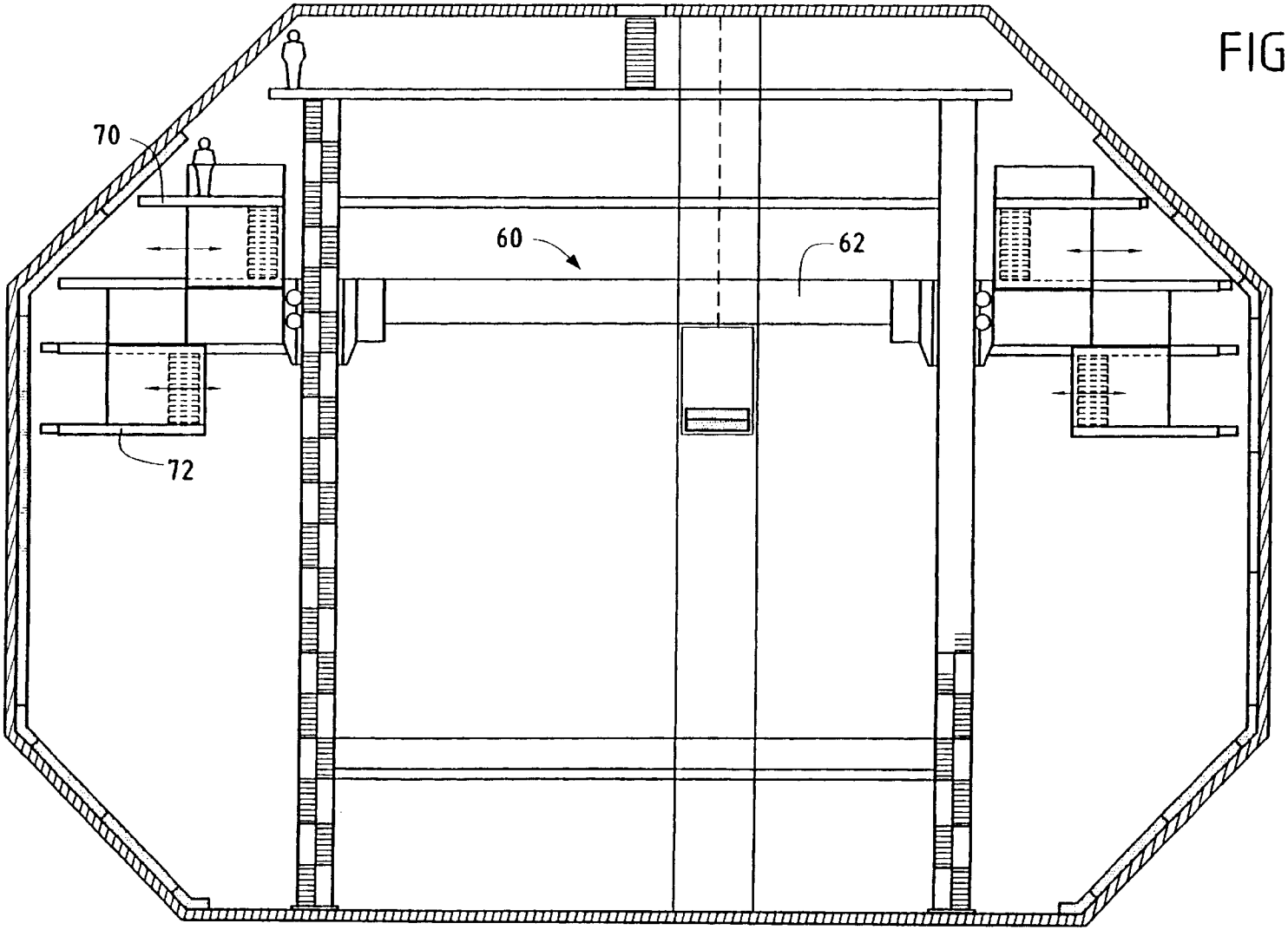
FIG. 4 is a view similar to FIG. 3 showing the main platform in its high position.

The way in which such a scaffolding system is used can be seen clearly from the above description. When the main platform 60 is facing a vertical wall, the top and bottom auxiliary platforms 70 and 72 occupy positions that correspond to the outer edges of the main platform 60. Four working levels are thus made available. When the main platform is close to the ceiling of the tank, the top auxiliary platforms 70 occupy a retracted position relative to the outer edges of the main platform, as shown in FIG. 4. the top auxiliary platform provides a working zone for reaching the top sloping walls. In contrast, the bottom auxiliary platform 72 is naturally in alignment with the outer edge of the main platform.

It will be understood that when the main platform 60 is in a low position it is the bottom auxiliary platforms 72 which occupy a retracted position so as to give access to the bottom sloping walls. In contrast, the top auxiliary platform 70 is in alignment with the edge of the main platform.

It will be understood that because the gantry is longitudinally movable and because the main platform is vertically movable, in combination with the auxiliary platforms being horizontally movable relative to the main platform, it is possible to reach each zone of the wall of the volume by means of a working floor regardless of the shape of the wall of the volume.

Figure 3:
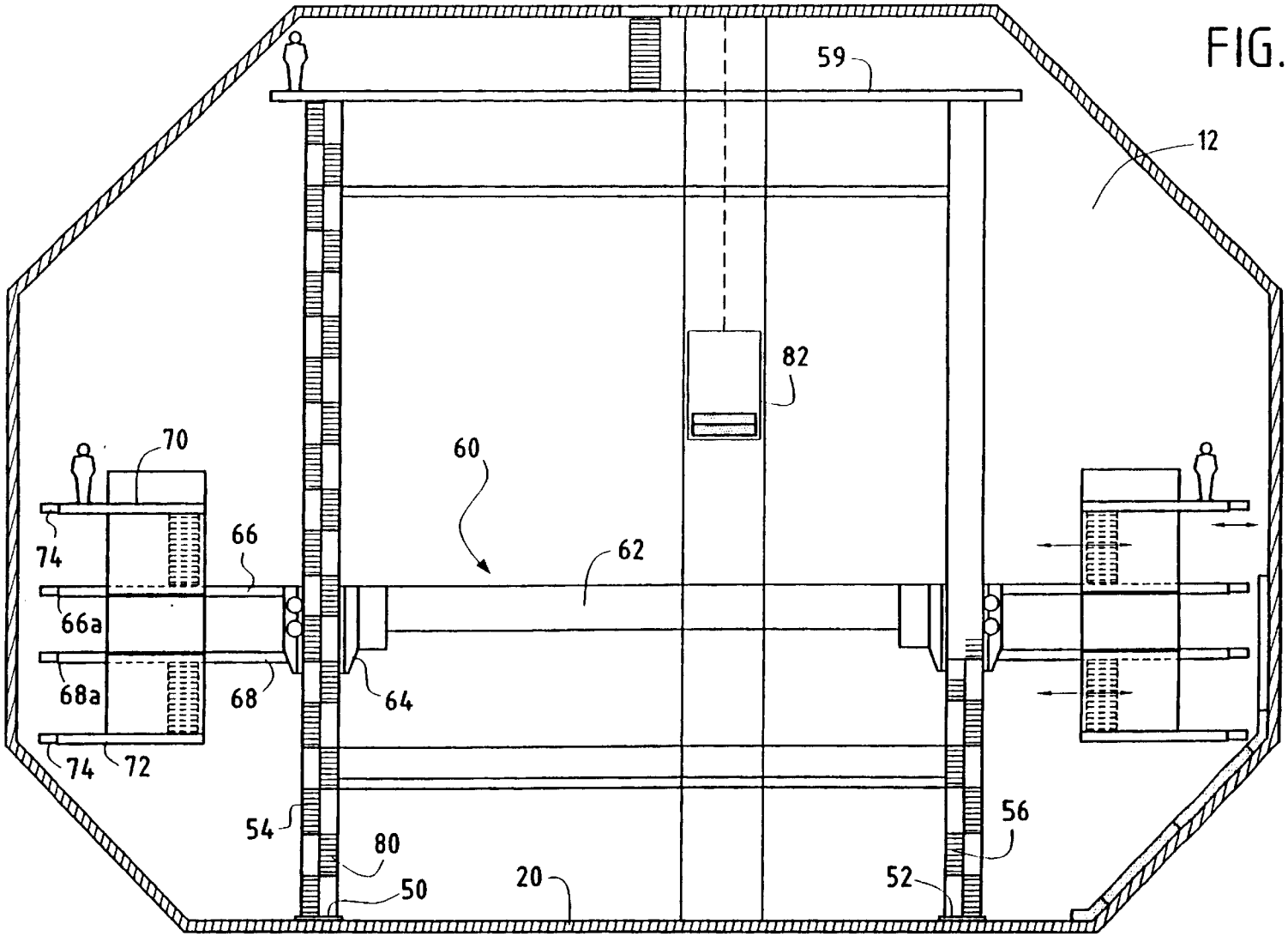
FIG. 3 is a cross-section view showing the entire scaffolding structure, the main platform being at an intermediate position.
Figure 3A:
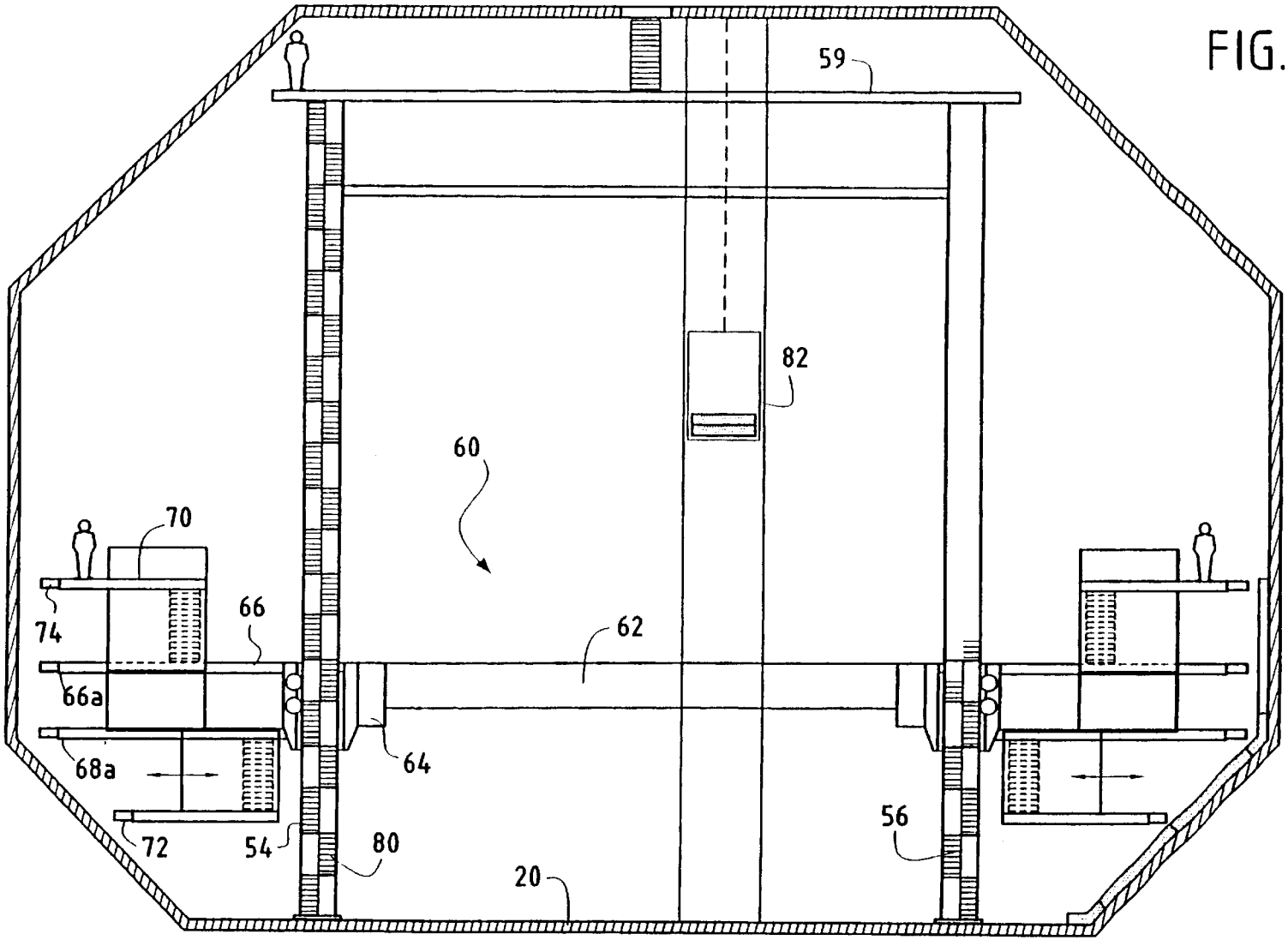
FIG. 3A is a cross-section view showing the main platform in its low position.

As already mentioned, the end scaffolding structures 40 and 42 have exactly the same general structure as the scaffolding structure 44 described above with reference to FIGS. 2 to 4. In other words, each scaffolding structure 40, 42 likewise comprises a gantry, a main platform, and two top auxiliary platforms together with two bottom auxiliary platforms identical to those of the structure 44. On its side facing the adjacent end wall 25 or 27 each of them also has a telescopic extension 75. They can also have corner extensions 77 that are telescopically mounted on a direction at about 45° relative to the displacement direction of the extensions 75.

It will be understood that the scaffolding structure makes it possible to reach any zone of the wall of the volume regardless of the shape of the volume. It can also be seen clearly that the relatively small number of working floors makes it easy to handle lagging elements of large dimensions, which corresponds to the techniques now in use, in particular for the tanks of ships that transport liquefied gas.

What is claimed is:

1. A scaffolding system adapted to be used with volumes of various shapes presenting a bottom and end walls, said system comprising at least a first scaffolding structure comprising:

a gantry structure comprising at least two vertical poles interconnected to form a gantry, each of said poles having a bottom end;

guiding means adapted to be secured to said bottom of the volume to guide said bottom ends of the poles in rectilinear displacement in a longitudinal direction on said bottom;

a horizontal main platform defining at least one working floor;

means for guiding said main platform means in vertical translation along said poles, said main platform means having two end edges in a direction orthogonal to the displacement direction of said gantry;

at least two horizontal auxiliary platforms each defining a working floor, mounted on said main platform means at each end edges thereof to move in horizontal translation relative to said main platform, each auxiliary platform having an outer edge; and means for displacing each auxiliary platform separately relative to said main platform between a retracted position in which the outer edge of the auxiliary platform is retracted relative to the outer edge of the main platform, and an extended position in which the outer edge of the auxiliary platform is substantially vertically in register with the outer edge of the main platform, whereby all of the walls of the volume can be reached from a working floor, whatever the shape of the volume.

2. A scaffolding system according to claim 1, further comprising at least second and third scaffolding structures similar to said first scaffolding structure.

3. A scaffolding system according to claim 2, wherein said second and third scaffolding structures are for spacing between the end walls of said volume, and said main platforms of said structures include moving extensions on their respective edges facing said end walls.

4. A scaffolding system according to claim 2, wherein said main platform of each scaffolding structure has a top face, a bottom face and four auxiliary platforms, two auxiliary platforms being movable relative to said top face of the main platform and the other two auxiliary platforms being mounted to move relative to said bottom face of the main platform.

5. A scaffolding system according to claim 2, wherein said main platforms define two superposed working floors.

6. A scaffolding system according to claim 2, wherein each main platform has two extensions movable in translation between a first position in which said extension in register with said main platform and a second position in which said extension projects beyond the outer edge of the main platform.

7. A scaffolding system according to claim 2, wherein each auxiliary platform has an extension that is movable in translation between a first position in register with said auxiliary platform and a second position in which said extension projects beyond the outer edge of said auxiliary platform.

8. A scaffolding system according to claim 2, wherein each gantry has four vertical poles forming edges of a rectangular parallelepiped, said auxiliary platforms being mounted to move in two zones of the main platform extending at the end of said parallelepiped in a direction that is orthogonal to said displacement direction of said gantry.

9. A scaffolding system according to claim 2, wherein said main platform of said scaffolding structure has a top face, a bottom face and four auxiliary platforms, two auxiliary platforms being movable relative to said top face of the main platform, and the other two auxiliary platforms being mounted to move relative to said bottom face of the main platform.

10. A scaffolding system according to claim 2, wherein said main platform has two extensions movable in translation between a first position in which said extension is in register with said main platform and a second position in which said extension projects beyond the outer edge of the main platform.

11. A scaffolding system according to claim 1, wherein said main platform has a top face, a bottom face and four auxiliary platforms, two auxiliary platforms being movable relative to said top face of the main platform, and the other two auxiliary platforms being mounted to move relative to said bottom face of the main platform.

12. A scaffolding system according to claim 11, wherein said main platform defines two superposed working floors.

13. A scaffolding system according to claim 11, wherein said main platform has two further extensions movable in translation between a first position in which said extension is in register with said main platform and a second position in which said extension projects beyond the outer edge of the main platform.

14. A scaffolding system according to claim 1, wherein each auxiliary platform has an extension that is movable in translation between a first position in register with said auxiliary platform and a second position in which said extension projects beyond the outer edge of said auxiliary platform.

15. A scaffolding system according to claim 1, wherein said gantry has four vertical poles forming edges of a rectangular parallelepiped, said auxiliary platforms being mounted to move in two zones of the main platform extending at the end of said parallelepiped in a direction that is orthogonal to said displacement direction of said gantry.

16. A scaffolding system according to claim 1, wherein said gantry has four vertical poles forming edges of a rectangular parallelepiped, said auxiliary platforms being mounted to move in two zones of the main platform extending at the end of said parallelepiped in a direction that is orthogonal to said displacement direction of said gantry.

17. A scaffolding system adapted to be used with volumes of various shapes presenting a bottom and end walls, said system comprising at least a first scaffolding structure comprising:

a gantry structure comprising at least two vertical poles interconnected to form a gantry, each of said poles having a bottom end;

pole guiding means adapted to be secured to said bottom of the volume to guide said bottom ends of the poles in rectilinear displacement in a longitudinal direction on said bottom;

a horizontal main platform defining working floors outside a zone defined by said vertical poles in the direction orthogonal to the displacement;

main platform guiding means adapted to be secured to said main platform means for guiding said main platform means in vertical translation along said poles, said main platform means having two end edges in a direction orthogonal to the displacement direction of said gantry;

at least two horizontal auxiliary platforms each defining a working floor, mounted on said main platform means at each end edge thereof to move in horizontal translation relative to said main platform means, each auxiliary platform having an outer edge; and displacement means for displacing each auxiliary platform separately relative to said main platform between a retracted position in which the outer edge of the auxiliary platform is retracted relative to the outer edge of the main platform, and an extended position in which the outer edge of the auxiliary platform is substantially vertically in register with the outer edge of the main platform, whereby all of the walls of the volume can be reached from a working floor, whatever the shape of the volume.

* * * * *